US007828196B2

(12) United States Patent
De Pagter et al.

(10) Patent No.: US 7,828,196 B2
(45) Date of Patent: Nov. 9, 2010

(54) TRANSPORT CONTAINER WITH IMPROVED VENTILATION PROPERTIES FOR FLOWERS

(75) Inventors: Janus Adriaan Willem De Pagter, Dinteloord (NL); Jeroen Johan Bruijns, Zevenbergen (NL); Simon Eduard Niekolaas, Delft (NL)

(73) Assignee: Pagter & Partners International B.V., Roosendaal (NL)

( * ) Notice: Subject to any disclaimer, the term of this patent is extended or adjusted under 35 U.S.C. 154(b) by 44 days.

(21) Appl. No.: 12/089,075

(22) PCT Filed: Sep. 1, 2006

(86) PCT No.: PCT/NL2006/050214

§ 371 (c)(1),
(2), (4) Date: Jun. 1, 2008

(87) PCT Pub. No.: WO2007/027094

PCT Pub. Date: Mar. 8, 2007

(65) Prior Publication Data

US 2009/0159476 A1 Jun. 25, 2009

(30) Foreign Application Priority Data

Sep. 2, 2005 (NL) ..... 1029865

(51) Int. Cl.
*B65D 5/00* (2006.01)

(52) U.S. Cl. ..... 229/120; 217/42; 220/913

(58) Field of Classification Search ..... 206/423; 220/366.1, 367.1, 913; 217/42, 74; 229/120
See application file for complete search history.

(56) References Cited

U.S. PATENT DOCUMENTS

| | | | | | |
|---|---|---|---|---|---|
| 1,216,031 | A * | 2/1917 | Wilcox | 206/270 |
| 3,341,064 | A * | 9/1967 | Ricci | 206/512 |
| 3,863,831 | A * | 2/1975 | Wozniacki et al. | 229/120 |
| 4,058,214 | A * | 11/1977 | Mancuso | 206/545 |
| 5,065,889 | A * | 11/1991 | Conti | 220/360 |
| 5,390,847 | A * | 2/1995 | Young | 229/122.21 |
| 5,465,901 | A * | 11/1995 | Paine, Jr. | 229/407 |
| 5,592,775 | A * | 1/1997 | Dew | 47/61 |
| 7,441,672 | B2 * | 10/2008 | Cadiente et al. | 220/608 |
| 2003/0052133 | A1 | 3/2003 | Hayes et al. | |
| 2006/0138134 | A1 * | 6/2006 | Martin | 220/253 |

FOREIGN PATENT DOCUMENTS

| | | |
|---|---|---|
| GB | 981994 | 2/1965 |
| GB | 1221513 | 2/1971 |
| NL | 7313121 | 12/1974 |

OTHER PUBLICATIONS

International Search Report dated Jan. 26, 2007.

* cited by examiner

*Primary Examiner*—David T Fidei
(74) *Attorney, Agent, or Firm*—Young & Thompson

(57) ABSTRACT

A container for flowers and such includes a stackable holder with upright walls, a carrier supported on the walls, an upper holder being placeable on the carrier, and also A ventilation element located in at least one of the walls and also at the top of the carrier. The ventilation element includes at least one recess opening out at the upper edge of the wall.

19 Claims, 4 Drawing Sheets

TRANSPORT CONTAINER WITH IMPROVED VENTILATION PROPERTIES FOR FLOWERS

The invention relates to a container for a stackable holder with upright walls, a carrier supported on the walls, an upper holder being placeable on said carrier, and also ventilation means in at least one of the walls as well as at the top of the carrier, said ventilation means comprising at least one recess opening out at the upper edge of a wall.

BACKGROUND OF THE INVENTION

A container of this type is known from U.S. Pat. No. 5,390,847. Containers for flowers used in particular in the transport thereof, are generally known. Transport of large quantities of flowers normally takes place by stacking such containers close together and on top of one another on a pallet. In this state the packaged flowers can be efficiently transported by road and also by air. In view of the limited storage life of products such as flowers the conditions in which the flowers are transported must be optimal.

In this respect it is of great importance that the flowers can also be ventilated during transport. However, if transport takes place, as described above, in a state in which the flower containers are stacked close together and on top of one another, the ventilation leaves a lot to be desired. This problem occurs in particular with flowers located in containers located more in the middle of such a stack. However, if there is poor ventilation, the temperature in the flower containers goes up, whereby the quality of the flowers concerned soon deteriorates.

Owing to the living nature of the flowers, over-heating occurs in the container. The warm air caused by this rises in relation to the cooler air. To remove this heat there has to be an opening inside the container, since, if the relatively warm air cannot escape, moisture precipitates from it. The buds of the packaged flowers located at the top of the container must remain dry at all times, however, which means that accumulation of relatively warm air inside is very undesirable.

The advantage of ventilation means in both the walls and the carrier is that the removal of relatively warm air is ensured at all times. The containers do not have to be positioned exactly opposite one another, as would certainly be the case if the ventilation means were located only in the walls. In the latter case it would be necessary constantly to ensure that said ventilation means are directly opposite one another. In practice, though, this is very difficult to achieve, because it is impossible to work so precisely.

The ventilation means can be implemented in several ways. They can have any desired shape, for example partially circular, polygonal, etc.

However, the recesses result in less effective support at the upper edge.

SUMMARY OF THE INVENTION

The aim of the invention is to improve the support while retaining the ventilation option. Said aim is achieved in that the carrier has a contour which follows the course of the recess opening out at the upper edge of the wall so that a groove or gap is formed in the stack of containers for ventilation. With this embodiment the carrier is reliably supported on the walls and not just on the top, non-recessed parts thereof.

In the known way the carrier can be designed as an open-work frame. According to the invention it can, in this case, be provided that this frame has a flat carrying part and also edges protruding downwards in relation to the carrying section, which follow the contours of the recess opening out at the upper edge of the associated wall. The recesses are then located between the flat carrying section and the edges. With respect to the stability of the container, in particular relating to supporting further stacked containers lying on top, a support prop can extend between the flat carrying section and each edge.

The ventilation means can also comprise a further recess bordering on the recess in the upper wall and located in the carrier. The recesses in the walls and the further recesses in the carrier blend into one another in pairs such that the ventilation can be even further improved. The further recesses can be delimited by a receding section of the carrier. In this case the support prop can extend between the edge and the receding section.

With respect to the strength of the containers it can further be provided that the edges each extend between two corners of the carrying section and end at a distance from each corner, forming flat bearing sections at each corner. The carrier can also have upright parts in which an upper carrier can be positioned. A carrier of this type can be particularly successfully made of plastics material and manufactured by means of injection-moulding, for example.

The invention will be explained in more detail below with the aid of an illustrative embodiment shown in the figures.

DETAILED DESCRIPTION OF THE PREFERRED EMBODIMENTS

Figure 1:
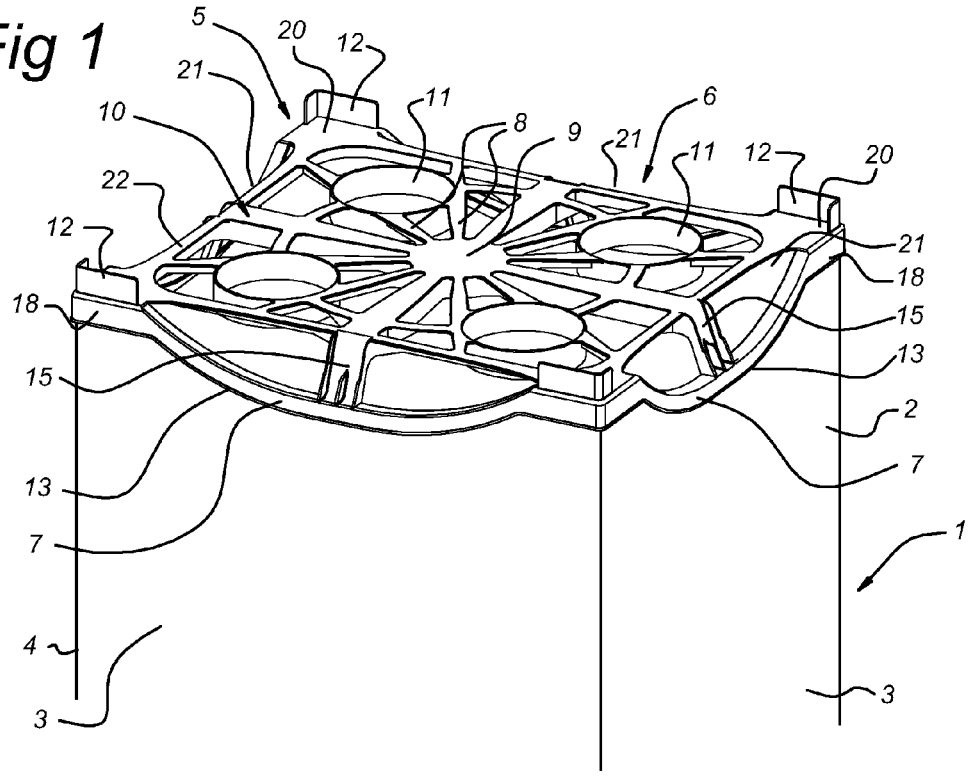
FIG. 1 shows a view of the top of a container according to the invention.

The container 1 according to the invention shown in FIG. 1 comprises a box-shaped holder 2, which in the illustrative embodiment shown has four walls 3. Said walls 3 are joined to one another in pairs at the corners 4 at right angles. On the top of the holder 2 a carrier is placed, indicated in its entirety as 5. Said carrier 5 comprises a substantially flat carrying section 6 and also curved edges 7, running downwards in relation to the flat carrying section 6. The flat carrying section 6 is open-work and comprises a number of strips 8, which run like rays from a centre 9 towards the substantially square framework 10.

The corner edges 12 stick up in relation to the flat carrying section 6. Within these corner edges 12, another holder 2 can be placed on the flat carrying section 6, in particular on the bearing sections 20. The corner pieces 18 protrude downwards in relation to the flat carrying section 6, in order to be able to satisfactorily enclose one of the corners of the walls 3 of the underlying holder 2.

Figure 2:
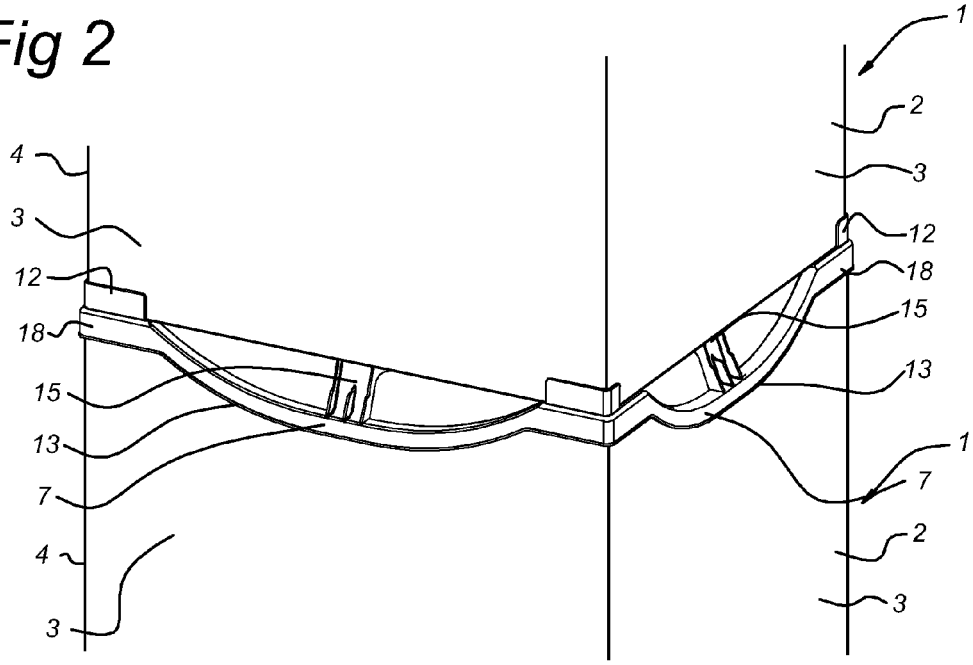
FIG. 2 shows a view of a stack of containers according to FIG. 1.

Each of the walls 3 of the holder 2 has a recess 13 open towards the top. These recesses 13 are formed such that the edges 7 rest on the top edges 14 (see FIG. 3) of said recesses 13. The edges 7 are joined to the framework 10 by supports 15, such that good support is ensured for an upper holder 1 on the walls 3 of the underlying holder 2. These positions of an upper holder 2 and an underlying holder 2 are illustrated in FIG. 2. It is also clear in said figure that the recesses 13 in the walls 3 of the underlying holder 2 form ventilation openings, such that the contents of the containers 1, in particular flowers, can be transported in the right conditions.

The flat carrying section 6 is delimited by receding edges 22, which define further recesses 21. Said further recesses 21 blend into the recesses 13 in the walls, whereby the ventilation can be further improved.

Figure 3:
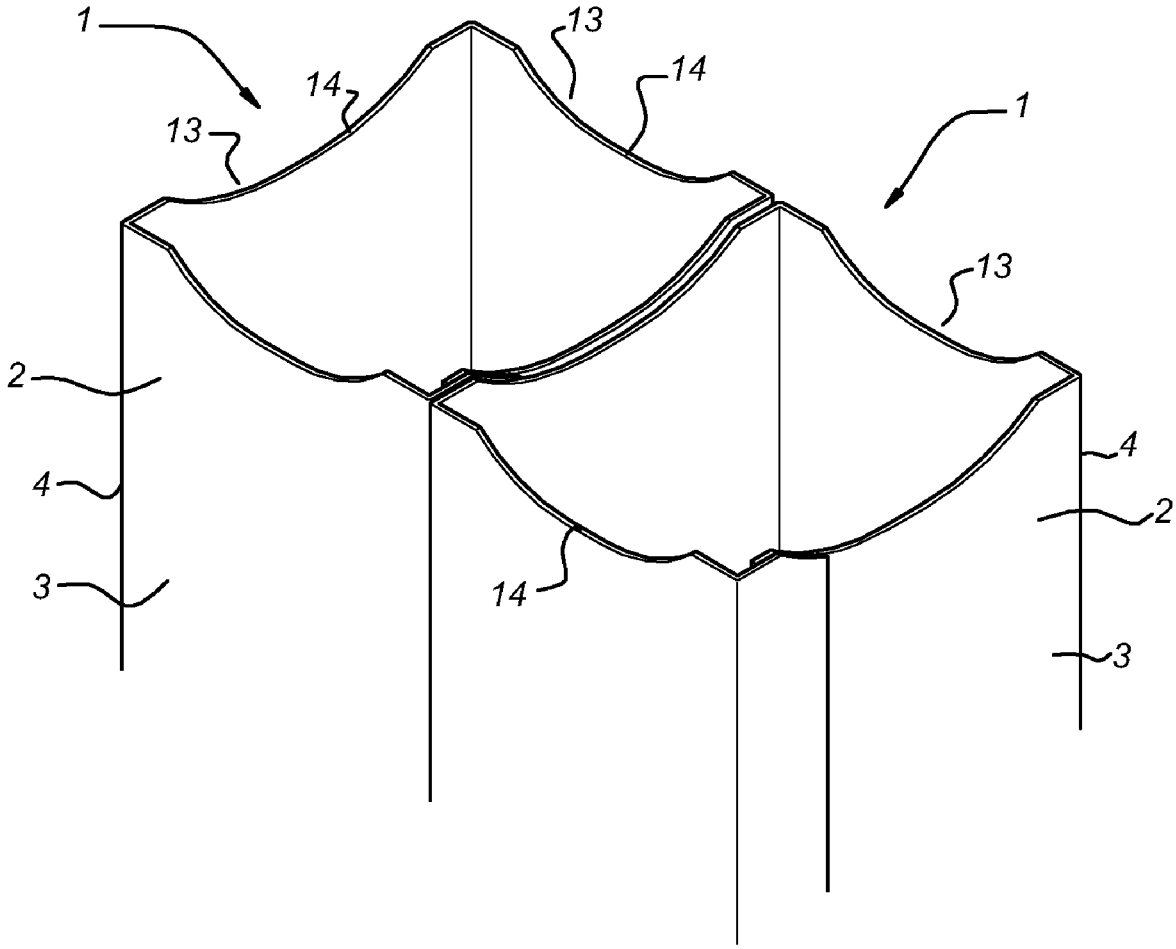
FIG. 3 shows a further view of a stack of containers according to the invention as accommodated on a pallet.

In the position illustrated in FIG. 3, wherein the containers 1 with their holders 2 are placed next to one another, these recesses 13 also act as ventilation openings. The recesses 13 of two neighbouring holders 2 directly adjoining one another are directly opposite one another, such that they produce a through ventilation channel, whereby the contents of the holders 2 can be provided with fresh air, even if they are located in the middle of a pallet (not illustrated).

Figure 4:
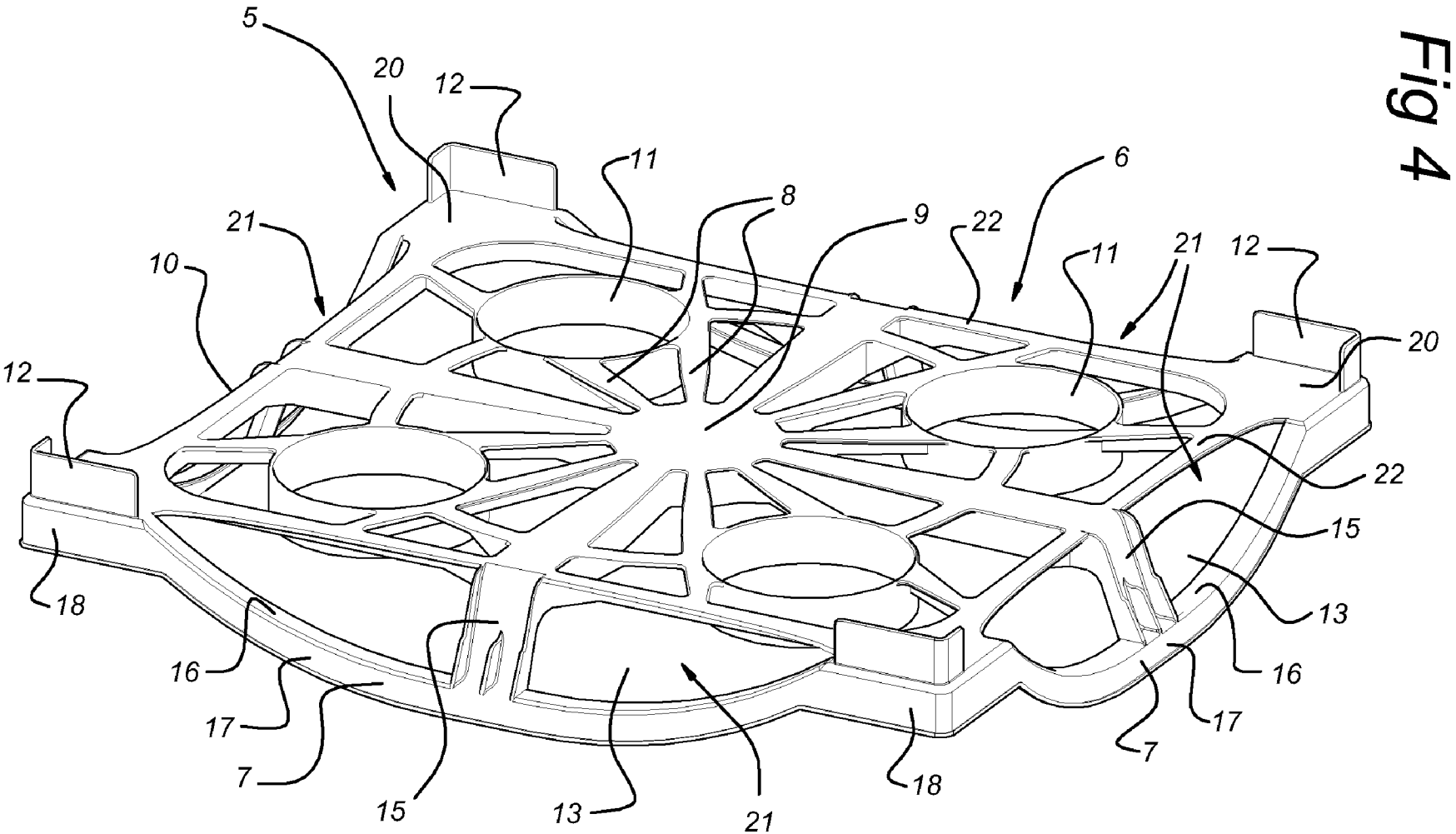
FIG. 4 shows a top view of a carrier for use with the container according to the invention.
Figure 5:
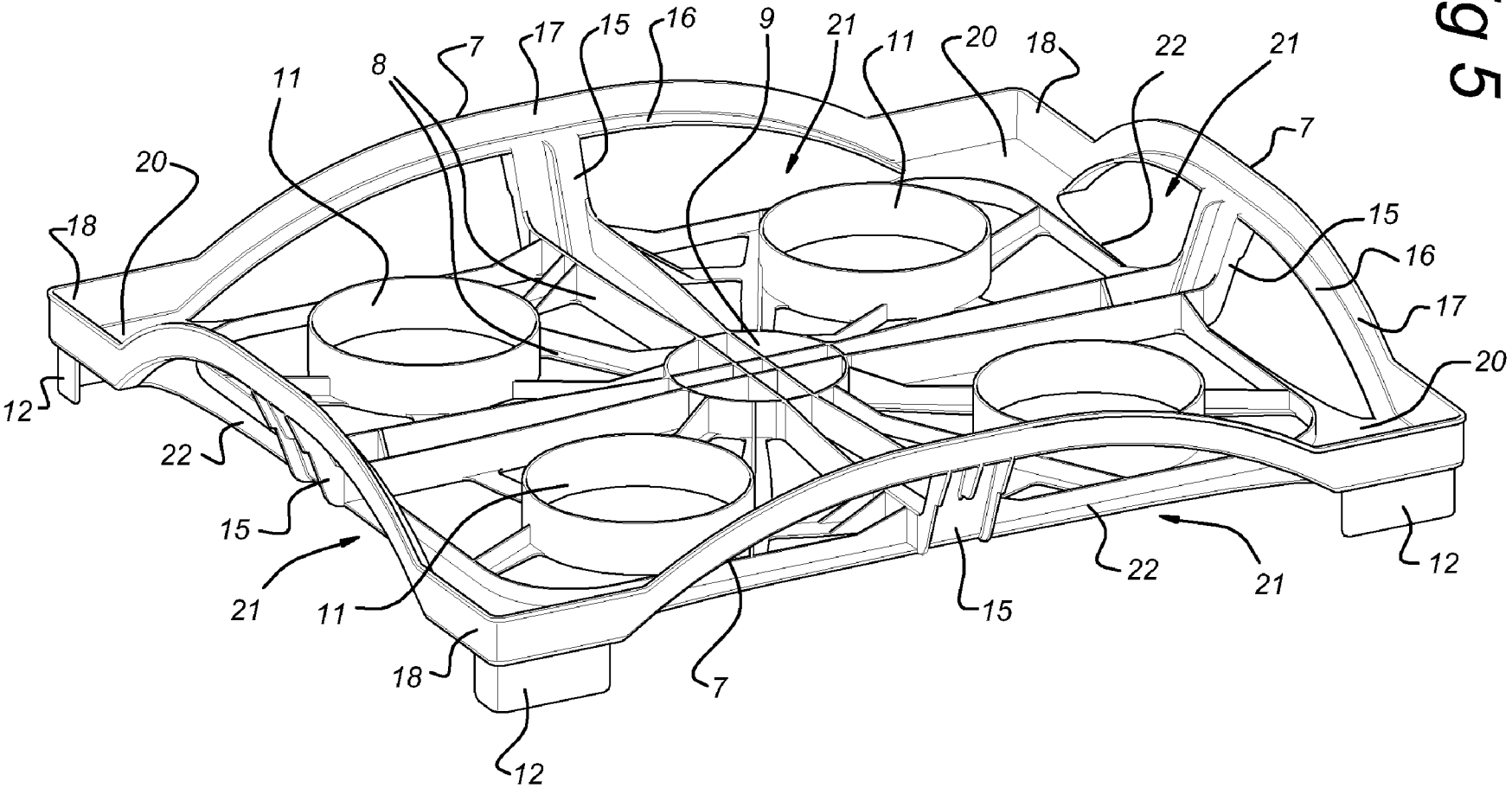
FIG. 5 shows a bottom view of the carrier according to FIG. 4.

In the views in perspective of FIGS. 4 and 5 the carriers 5 are illustrated separately. As can be seen in the bottom view of FIG. 5 the edges 7 have an L-shaped cross-section, with a horizontal leg 16 and a vertical leg 17. It will be clear that the horizontal legs 16 of the edges 7 come to rest on the top edges 14 of the walls 3 of the holder 2. The vertical legs 17 of the edges 7 ensure that the walls 3 remain well positioned.

Also to be seen in the bottom view of FIG. 5 are the corner pieces 18, pointing downwards, in which the corners of the walls 3 of the holders 2 can be stably positioned.

As discussed above, the recesses 13 provide horizontally running ventilation channels when containers 1 are placed next to one another. In the case of the carriers 5, ventilation is also possible in the vertical direction, however, in view of the open-work nature of the flat carrying sections 6 of the carriers 5 and in particular the further recesses 21.

The invention claimed is:

1. A container (1) for flowers, comprising:

a first stackable holder (2) with upright walls (3);

a carrier (5) with a first side supported on the upright walls (3); and ventilation means located in at least one of the upright walls (3) and at a top of the carrier (5), said ventilation means comprising at least one wall recess (13) opening out at a top edge (14) of the at least one of the upright walls (3), wherein the carrier (5) has a second side opposite the first side and configured to connect with a second holder, and wherein the carrier (5) has a flat carrying section (6), and at least one edge (7) protruding downwards in relation to the flat carrying section (6) and configured to contact an entirety of a contour of the at least one wall recess (13).

2. The container according to claim 1, wherein the carrier (5) is configured as an open-work frame.

3. The container according to claim 1, wherein the at least one edge (7) extends between two corners of the flat carrying section (6) and ends at a distance from each corner, forming flat bearing sections (20) at each of the two corners.

4. The container according to claim 1, wherein a support prop (15) extends between the flat carrying section (6) and at least one edge (7).

5. The container according to claim 1, wherein the ventilation means comprise a further recess (21) bordering on the wall recess (13).

6. The container according to claim 5, wherein the further recess (21) is delimited by a receding section (22) of the carrier (5).

7. The container according to claim 6, wherein the support prop (15) extends between the edge (7) and the receding section (22).

8. The container according to claim 1, wherein the carrier (6) is configured as a lid.

9. The container according to claim 1, wherein the carrier (6) has upright parts (12) in which the second holder (2) can be positioned.

10. The container according to claim 1, wherein the carrier (6) comprises plastics material.

11. The container according to claim 1, wherein the wall recess (13) is located in a middle of the at least one upright wall (3) between two corners thereof.

12. The container according to claim 1, wherein each of the upright walls (3) is provided with a respective recess (13), and the carrier (5) comprises further recesses (21) blending into the respective recesses of the upright walls (3).

13. The container according to claim 12, wherein the respective recesses (13) are located at a same height in each of the upright walls (3).

14. An assembly comprising two containers (1) according to claim 1 placed next to one another, wherein the wall recesses (13) in adjacent upright walls (3) of the two containers (1) adjoin one another.

15. The container according to claim 2, wherein the carrier (5) has a flat carrying section (6), and at least one edge (7) protruding downwards in relation to the flat carrying section (6), configured to follow the contour of the at least one wall recess (13).

16. The container according to claim 3, wherein a support prop (15) extends between the flat carrying section (6) and the at least one edge (7).

17. The container according to claim 2, wherein the ventilation means comprise a further recess (21) bordering on the wall recess (13).

18. The container according to claim 1, wherein the ventilation means comprise a further recess (21) bordering on the wall recess (13).

19. The container according to claim 4, wherein the ventilation means comprise a further recess (21) bordering on the wall recess (13).

* * * * *